US005902200A

United States Patent [19]

Herz

[11] Patent Number: 5,902,200

[45] Date of Patent: May 11, 1999

[54] CURLING STONE FOR USE IN CURLING WITH CONTINUOUSLY VARIABLE GLIDING CHARACTERISTICS

[76] Inventor: Josef Paul Herz, Ebnerwiese 63, A-9800 Spittal, Austria

[21] Appl. No.: 08/952,841

[22] PCT Filed: May 22, 1996

[86] PCT No.: PCT/AT96/00097

§ 371 Date: Jan. 23, 1998

§ 102(e) Date: Jan. 23, 1998

[87] PCT Pub. No.: WO96/37268

PCT Pub. Date: Nov. 28, 1996

[30] Foreign Application Priority Data

May 22, 1995 [AT] Austria ..... 857/95

[51] Int. Cl.[6] ..... A63B 67/14

[52] U.S. Cl. ..... 473/587

[58] Field of Search ..... 473/587, 588, 473/589, FOR 229, 230, 231

[56] References Cited

U.S. PATENT DOCUMENTS

| | | | |
|---|---|---|---|
| 3,870,309 | 3/1975 | Tessier | 473/587 |

FOREIGN PATENT DOCUMENTS

| | | | |
|---|---|---|---|
| 354921 | 2/1980 | Austria . | |
| 820106 | 11/1951 | Germany . | |
| 1936435 | 1/1971 | Germany . | |
| 2431364 | 1/1976 | Germany | 473/FOR 230 |
| 3346729 | 7/1985 | Germany | 473/FOR 230 |
| 4124316 | 2/1992 | Germany | 473/FOR 230 |

*Primary Examiner*—Raleigh W. Chiu
*Attorney, Agent, or Firm*—Karl Hormann

[57] ABSTRACT

The present invention relates to a curling stone known wherein a support shell provided with one of more openings for rendering the brake device accessible is supportively placed between the handle and the housing, the support shell being provided in its upper surface with a central bore. In a preferred embodiment, the bracket of the brake device is an inherently resilient support member of star-shaped cross-sectional configuration with preferably three to six arms, radially narrowing slots being provided in the arms for receiving the brake surface supports.

8 Claims, 2 Drawing Sheets

Fig. 2
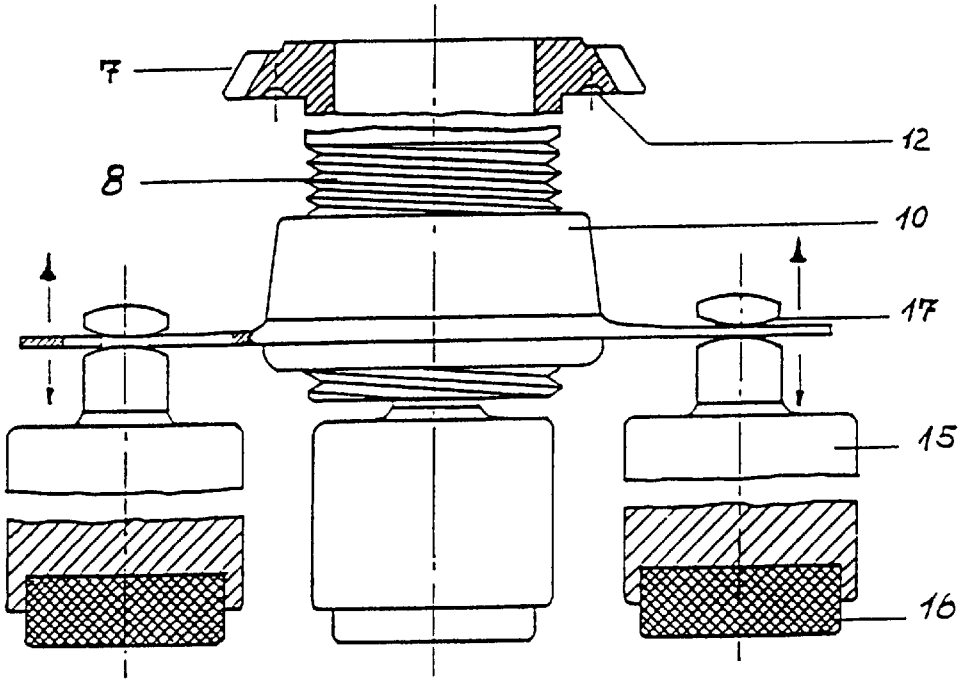
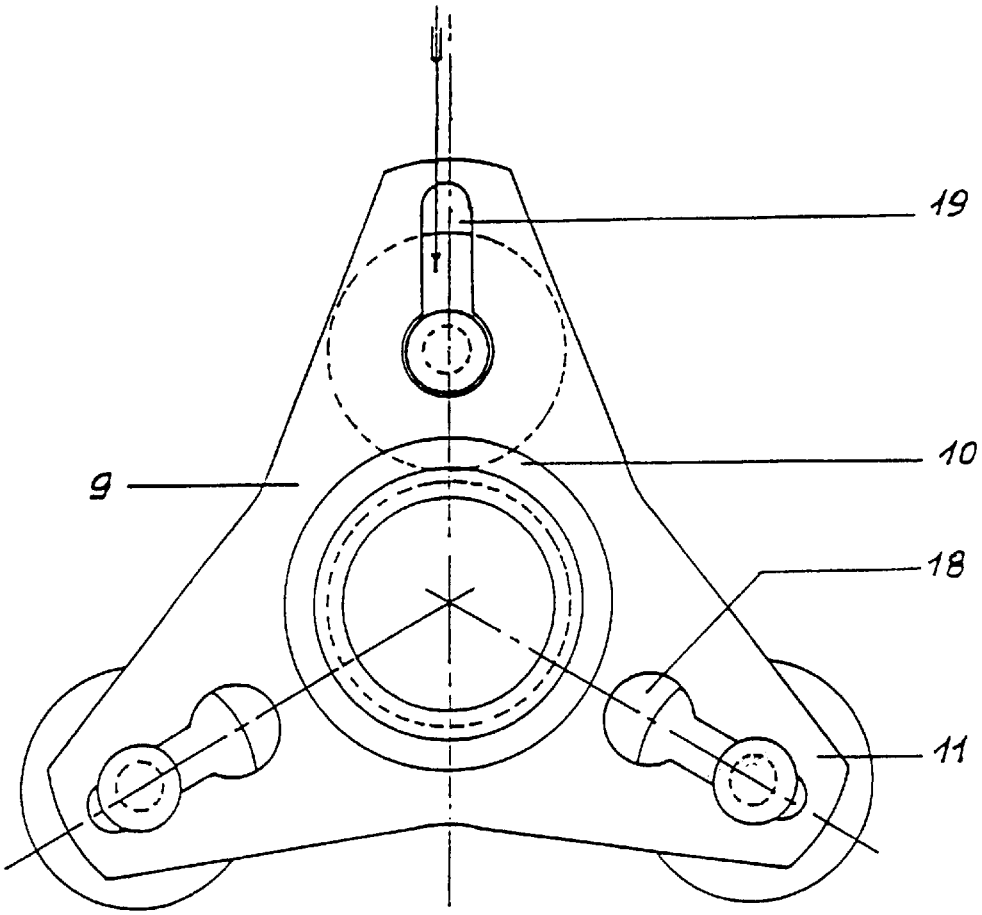
Fig. 3

CURLING STONE FOR USE IN CURLING WITH CONTINUOUSLY VARIABLE GLIDING CHARACTERISTICS

BACKGROUND OF THE INVENTION

1. Field of Invention

The invention relates to a curling stone for curling, consisting of a handle, a housing for the support of gliding and braking elements, and a bottom glide plate covering the bottom side of the housing and optionally provided with gliding bumps, part of the gliding surface being formed by a brake device the braking surface of which is affixed to a support for sliding movement in an axial direction of the curling stone relative to the remaining gliding surface cover and moveable against spring bias in the housing to adjust the brake action, the brake device consisting of a plurality of independently moveable brake surface supports arranged concentrically and symmetrically around the axis of the curling stone on a common bracket which is axially adjustable to a limited extent relative to the curling stone, each support being provided with its own spring suspension.

Such a curling stone may be easily adjusted without further auxiliary means in accordance with temperature induced changes in the antifrictional properties of the ice as they occur in practice.

2. The Prior Art

A curling stone of the kind mentioned above is known from Austrian patent No. 354,921. Even though that curling stone permits satisfactory adjustments to different gliding properties of ice, it has for several reasons been found to warrant improvement. Collisions with other curling stones may lead to unseating of the housing so that the hand wheel for adjusting the brake device is pressed against the lower flange at the end of the handle and is blocked, thus making further adjustments of the brake device impossible. Furthermore, in operation, such major components as handle, housing, and bottom glide plate with its steel ring may shift, since unlike in conventional curling stones the handle is not threadedly connected to the housing and to the bottom glide plate. Moreover, the use of coil springs, notwithstanding the advantages yielded by them, has been found to be disadvantageous as the brake surface supports cannot be quickly replaced.

OBJECTS OF THE INVENTION

Therefore, it is an object of the present invention to provide an improvement in the known curling stone to avoid the mentioned disadvantages which, in particular, make any adjustments of the brake device difficult or impossible, and to provide for simplified handling, especially as regards the brake device.

BRIEF SUMMARY OF THE INVENTION

In accordance with the invention, the object is accomplished by supportively arranging in the known curling stone, between the handle and the housing, a support shell preferably provided with one or more milled openings to render the brake device accessible, the support shell being in its upper surface provided with a central bore.

In another embodiment of the invention, the bracket of the brake device is an inherently resilient support of preferably star-shaped cross-section provided with a plurality arms (cantilevers), preferably three to six, with slots tapering in a radial direction for suspending the individual brake surface supports. In a further embodiment, the brake surface supports are provided with a stepped shaft provided with a preferably convex annular recess.

In contrast to the known use of coil springs, this embodiment of the brake device facilitates handling, in particular a quicker replacement of possibly worn brake surface supports. To this end, where brake surface supports are provided with stepped shafts, they are inserted into the slots at the widest portion thereof which is preferably shaped in the manner of a bore, and after snapping in their annular recess, they are pushed outwardly along the tapering slot into their final position. When in their idle or relieved state, the arms (cantilevers) may be slightly prestressed by about 3 mm in the direction of the bottom glide plate.

For setting the initial position of the brake surface supports, it is proposed that the bracket is preferably provided with an internally threaded bush in which a threaded spindle disposed beneath the support bell may be threadedly received for positional adjustments. The threaded spindle is provided with an axial bore into which a shaft of the handle is penetrating, and the shaft of the handle is at it threaded free end screwed into the bottom glide plate the marginal portion of the upper surface of which abuts against a steel ring disposed between the housing and the bottom glide plate, whereby the bottom glide plate is affixed to the curling stone and by mounting the hand wheel below the support shell positioned between the handle and the upper surface of the housing, the bracket is secured against axial displacement in the housing.

BRIEF DESCRIPTION OF THE DRAWINGS

The invention will hereafter be explained in detail with reference to the drawings.

FIGS. 1–3 depict a curling stone in accordance with the invention in half vertical section.

DETAILED DESCRIPTION OF PREFERRED EMBODIMENTS

Figure 1:
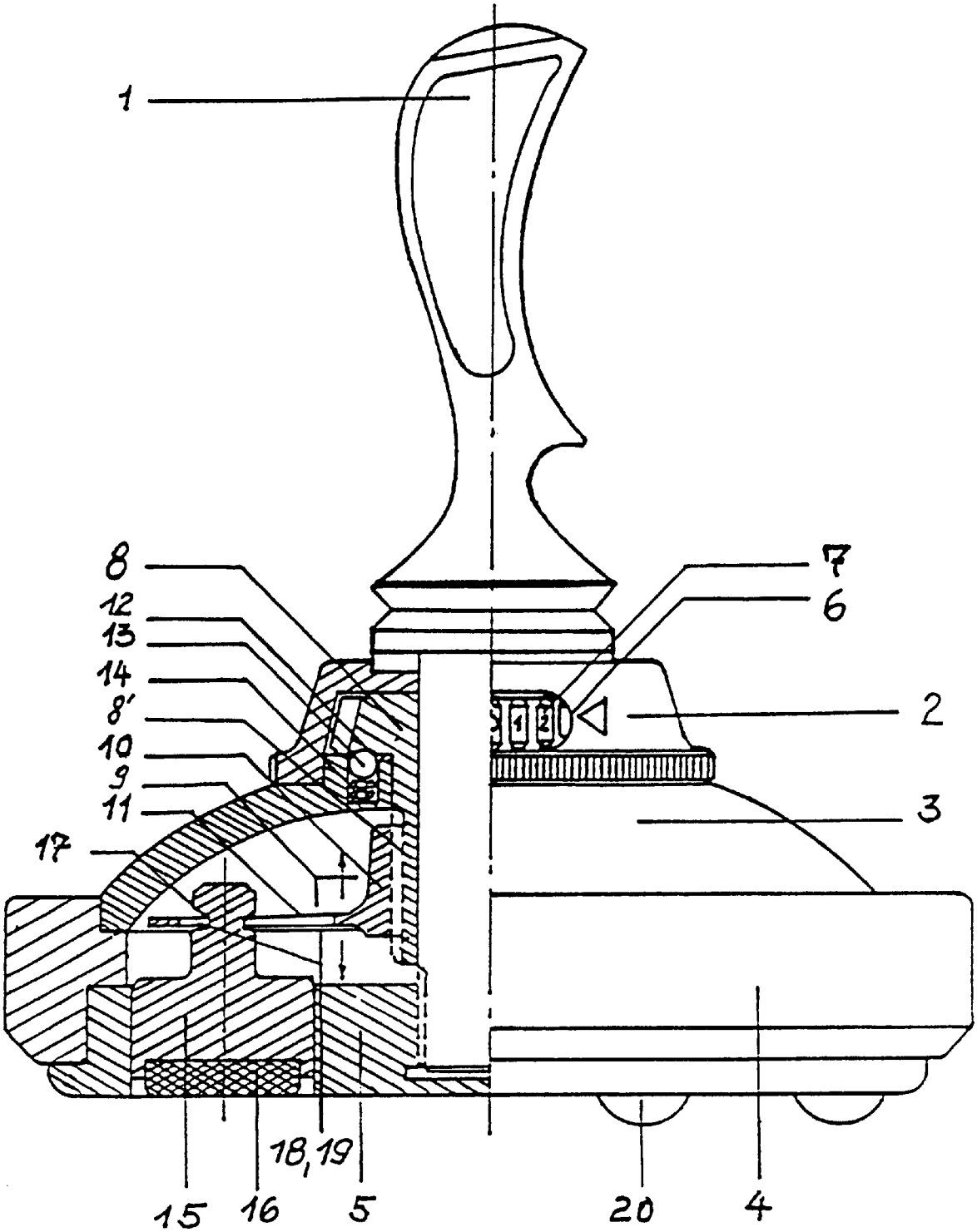

The curling stone in accordance with the invention consists of a handle 1, a support shell 2 supportively placed between the handle 1 and a housing 3, and of a bottom glide plate 5 connected to a steel ring 4. Instead of being of the convex configuration depicted in FIG. 1, the housing may also be conical. The support shell 2 is provided with one or more openings 6 which allow access to a hand wheel 7 preferably formed as a dial with numbered indicia thereon and being of smaller diameter than the support shell 2. Thus, no matter how tight it may be, the wheel may be freely rotated on the threaded shaft of the handle 1 for adjusting the brake device at any time. The hand wheel 7 constitutes the upper portion of a threaded spindle 8 which is adjustably connected by an external thread 8' to a bracket 9 of preferably star-shaped cross-section provided with an internally threaded bush 10. The bracket 9 is provided with a plurality of inherently resilient arms (cantilevers) 11, preferably three to six. At the bottom surface of the hand wheel 7 there are provided round recesses 12 into which a small ball 13 provided in the housing 3 and biased by a pressure spring 14 may drop in an indexing manner. Preferably, three to six brake surface supports 15 with brake linings 16 seated in their lower surfaces, are arranged in a partial circle on the inherently resilient arms. At their upper end, the brake lining supports 15 are provided with a concave annular recess 17 to compensate for axial displacements of the prestressed or resilient arms 11. The brake lining supports 15 are mounted on the arms 11 in radially narrowing slots 18, 19. The curling stone shown in FIG. 1 is additionally provided with glide bumps 20.

In FIGS. 2 and 3, an embodiment of a brake device is shown by way of example which is provided with three arms or brake surface supports, FIG. 1 depicting the brake device in partial section, including the threaded spindle and FIG. 2 depicting a top elevation of the brake device without the threaded spindle. The reference characters correspond to those of FIG. 1.

To prevent manipulation by third parties, the hand wheel may additionally by provided with a lock by means of a pressure latch of any desired construction.

Organic and inorganic felt products of any kind and shape (even brushes) made of various kinds of plastic and rubber or of cork may be used as brake linings. Silicon rubber of low Shore hardness has proven to be excellent as a slow lining. BY replacement of the bottom glide surface and, if necessary, of the bumps and the brake surface supports, the curling stone in accordance with the invention may be conventionally converted for use in ice-free seasons, as for instance, on asphalt surfaces.

What is claimed is:

1. A curling stone with continuously variable gliding properties, comprising:

a housing forming a planar first opening;

a substantially rigid annular member surrounding said first opening;

a handle mounted on said housing opposite said first opening;

means for forming an elongate shaft extending from said handle through said housing toward said first opening in a direction substantially normal thereto, said elongate shaft being externally threaded at its free end;

a glide plate peripherally abutting said annular member to cover said first opening and connected at its center to said free end of said elongate shaft, said glide plate being provided with a plurality of second openings substantially concentrically surrounding said elongate shaft;

means for forming a hollow externally threaded spindle rotatably seated on said elongate shaft;

a hand wheel integral with said hollow spindle externally of said housing opposite said glide plate means for selectively rotating said hollow spindle;

means for forming a shell provided between said handle and said housing for enclosing said hand wheel and provided with at least one peripheral aperture for accessing said hand wheel for rotation thereof;

means for forming at least one brake surface means slidably received in each of said second openings for supporting said at least one brake surface exposed to the exterior of said housing and provided with axial extensions directed into said housing; and means for forming a bracket threadedly connected at its center to said threaded spindle and provided with means for connection with said axial extensions of said supporting means, whereby rotation of said hand wheel causes said supporting means to move substantially parallel of said elongate shaft means thereby to control the extent of protrusion of said brake surfaces from said second openings.

2. The curling stone of claim 1, wherein said means for connection with said axial extensions comprises a plurality of radially extending resilient arms.

3. The curling stone of claim 2, wherein said radially extending arms are of equal lengths and disposed at equal angular spacings.

4. The curling stone of claim 3, wherein there are provided at least three arms.

5. The curling stone of claim 4, wherein said axial extensions of said supporting means are provided with substantially convex recesses and said arms are provided with radially extending and diminishing slots adapted to receive said recesses of said axial extensions.

6. The curling stone of claim 1, wherein said hand wheel is provided at its peripheral surface with numeric indicia visible through said aperture.

7. The curling stone of claim 1, wherein said hand wheel is provided with a surface having at least one recess therein facing said housing and wherein said housing is provided with resilient detent means adapted selectively to engage said at least one recess.

8. The curling stone of claim 7, wherein said detent means comprises a spring biased ball.

* * * * *